US005971075A

United States Patent [19]

Odru et al.

[11] Patent Number: 5,971,075

[45] Date of Patent: Oct. 26, 1999

[54] PRODUCTION RISER EQUIPPED WITH A SUITABLE STIFFENER AND WITH AN INDIVIDUAL FLOAT

[75] Inventors: Pierre Odru, Fontenaya Sous Bois; Francis Biolley, Paris, both of France

[73] Assignee: Institut Francais du Petrole, Rueil Malmaison Cedex, France

[21] Appl. No.: 08/941,213

[22] Filed: Sep. 30, 1997

[30] Foreign Application Priority Data

Sep. 30, 1996 [FR] France ..... 96 12343

[51] Int. Cl.[6] ..... E21B 17/00

[52] U.S. Cl. ..... 166/350; 166/367; 405/195.1

[58] Field of Search ..... 166/350, 367, 166/358; 405/195.1

[56] References Cited

U.S. PATENT DOCUMENTS

| | | | |
|---|---|---|---|
| 3,496,898 | 2/1970 | Morgan . | |
| 4,176,986 | 12/1979 | Taft et al. | 405/195.1 |
| 4,188,156 | 2/1980 | Fisher et al. | 405/195.1 |
| 4,234,047 | 11/1980 | Mott | 166/350 |
| 4,505,614 | 3/1985 | Anschutz | 405/195.1 |
| 4,643,614 | 2/1987 | Laursen | 405/195.1 |
| 4,702,321 | 10/1987 | Horton | 166/350 |
| 4,818,147 | 4/1989 | Rasmussen | 405/195.1 |
| 4,892,444 | 1/1990 | Moore | 166/350 |
| 5,615,977 | 4/1997 | Moses et al. | 166/350 |
| 5,722,492 | 3/1998 | Finn | 166/367 |
| 5,730,554 | 3/1998 | Mosley et al. | 166/350 |

FOREIGN PATENT DOCUMENTS

| | | |
|---|---|---|
| 424225 | 4/1991 | European Pat. Off. . |
| 9409245 | 4/1994 | WIPO . |
| 9507405 | 3/1995 | WIPO . |
| 9706341 | 2/1997 | WIPO . |

*Primary Examiner*—William Neuder
*Attorney, Agent, or Firm*—Antonelli, Terry, Stout & Kraus, LLP

[57] ABSTRACT

A drilling and/or production riser includes on at least part of the length thereof, a stiffener suited to withstand strains induced by the stresses transmitted by the marine environment, those induced by said supporting and guide device, and the strains due to the weight of the loads supported by said stiffener. System intended for production of petroleum effluents from a production site, such as one or more production wells, to a floater having at least one assembly allowing transfer of the effluents from at least one of the production wells to the floater. The assembly includes a production riser equipped on at least part of the length thereof with a float and with at least one stiffener situated above the float and suited to withstand strains induced by the stresses transmitted by the marine environment, those induced by said supporting and guide device and the strains due to the weight of the loads supported by said stiffener.

17 Claims, 3 Drawing Sheets

PRODUCTION RISER EQUIPPED WITH A SUITABLE STIFFENER AND WITH AN INDIVIDUAL FLOAT

FIELD OF THE INVENTION

The present invention relates to a production riser or riser pipe equipped with an individual float and with a stiffener suited to withstand various strains.

The present invention further relates to a production system for petroleum effluents, comprising a floater anchored to the sea bottom and connected to one or more production wells by means of one or more riser pipes or production risers equipped with at least one stiffener.

BACKGROUND OF THE INVENTION

Production systems are generally installed for relatively long periods, for example 20 years. Throughout the setting thereof and production operations, they undergo external strains and they are stressed by the wave motion, the current, the wind, etc.

The floater is usually anchored statically to the sea bottom by a set of chains or of vertical or oblique taut lines. In both cases, it retains a certain freedom of motion along various axes, that range between some centimeters and some meters for vertical displacements due to the wave motion, well-known as heave, and that can reach several ten meters in the horizontal plane. The amplitudes of the rotations about horizontal axes, known as roll and/or pitch, and about a vertical plane notably depend on the dimensions of the floater, on the anchor means thereof and on the wave motion conditions.

Conventionally, in such installations, riser pipes are on the one hand fastened to a subsea structure resting on the bottom and which generally includes several wellheads and, on the other hand, in direct or indirect connection with the floater. The connecting devices make the risers more or less dependent on the floater and therefore on the displacements thereof. In order that these displacements are bearable by the riser pipe, suspension systems or tensioning systems are generally used to maintain at the top of the riser pipe a relatively constant tension independent of the motions of the floater. Hydraulic tensioning systems can be used.

The prior art describes various layouts whose function is notably to take up the motions of the floaters and to disconnect them from the riser pipes.

For example, patent NO-171,958 describes a floating construction used for production of petroleum products including several riser pipes kept under tension from the wells on the sea bottom to a carrier deck that is mobile in relation to a floater. In this system, the carrier deck is connected to the floater by means of a hauling device for supporting both sways and vertical motions resulting from the motions of the floater. The riser pipes or production risers are connected to the carrier deck by means such as elastic elements for supporting vertical and lateral elastic motions. The use of both systems, the hauling system and the elastic elements, allows to prevent transmission of the motions of the floater to the production riser pipes. However, such an approach requires relatively complex mechanical devices, notably the hauling system, which increase the cost and the complexity of the entire production system.

The basic idea of U.S. Pat. No. 4,702,321 consists in using a caisson of sufficient size to contain the risers and their floats, and thus to shield them from the wave motion. Such a system can induce considerable stresses at the outlet of the guide system.

SUMMARY OF THE INVENTION

The object of the present invention is to minimize the strains existing at the level of the risers under the effect of the displacement of the floater, by proposing a system that is mechanically simpler than those known in the prior art.

In the present invention, unlike the prior art, no tensioning systems or means are used under normal working conditions, i.e. during production operations.

The invention is particularly well-suited for poorly rough or mild seas, when the floater does not undergo high stresses.

The present invention relates to a system intended for production of petroleum effluents from a production site, such as one or more production wells, to a floater. It is characterized in that it comprises in combination the following elements:

at least one production riser equipped on at least part of the length thereof with at least one means such as a tensioning buoy allowing to place said riser under tension, at least one device intended to support and to guide the riser with respect to said floater, at least one stiffener equipping at least part of the riser, over a length L, said stiffener being situated above said tensioning buoy, said stiffener being suited to withstand strains induced by the stresses transmitted by the marine environment, those induced by said supporting and guide device and the strains due to the weight of the loads supported by said stiffener.

The stiffener consists for example of a casing of length L surrounding said riser.

The system can comprise at least one element placed between the riser and the tensioning buoy so as to prevent flexion problems.

The supporting and guide device of a riser comprises at least one roller bearing system allowing vertical sliding of the riser and guiding the horizontal displacements thereof in a plane substantially perpendicular to the longitudinal sliding axis.

At least one of the supporting and guide devices of the riser comprises at least one system with double bearings, for example knuckles.

The riser comprises two ends, one of its ends communicating with a production well and the other with a wellhead, and said wellhead can be placed above the tensioning buoy.

The system can comprise several risers, said risers being connected to the floater by a means such as a grate equipped with means for guiding said risers.

When the stiffener consists of a casing surrounding the riser, the riser can be equipped with an auxiliary tensioning means.

The present invention also relates to a riser such as a drilling or a production riser comprising, on at least part of the length thereof, one or more stiffeners having characteristics suited to withstand strains induced by the stresses transmitted by the marine environment, those induced by said supporting and guide device and the strains due to the weight of the loads supported by said stiffener.

The present invention relates to a riser used within the scope of production or drilling of petroleum effluents, comprising on at least part of the length thereof at least one stiffening element. The stiffener can have thickness e and outside diameter $d_0$ characteristics determined according to the following stages:

1) Quasi-static extreme conditions are selected; these conditions can be given by maximum roll or pitch angle values or by uncommon current values such as hundred-year currents, or by extreme floater offset values.

2) During the first stage, the value of the moment M is determined by means of a suitable software for the riser not yet equipped with a stiffener, the values of the bending and of the tensile stresses are deduced and/or the values of the bending $\sigma f$ and/or tensile $\sigma t$ stresses in the riser are directly determined, the riser being not yet provided with a stiffener.

3) The stress values are compared with threshold values $\sigma fs$ and $\sigma ts$ at each point of the riser, and 4) When the stress values $\sigma f$, $\sigma t$ are greater than the threshold values, the value of the thickness e and/or the value of the outside diameter $d_0$ of the riser are varied and the stresses $\sigma f$, $\sigma t$ are recalculated until stress values that are acceptable in relation to the standard to be complied with by the riser are obtained, the final values $e_f$, $d_{0f}$ are noted, and 5) Dimensioning of the stiffener is performed with said final values.

The stiffening element consists of a tubular element having a length substantially equal to L, a thickness $e_f$ and an outside diameter $d_{0f}$, said tubular element surrounding the riser.

The tubular element can be connected to the riser by a tensioning element.

The present invention thus proposes a system that is simpler than those described in the prior art since it uses no mechanical tensioning system between the riser and the floater under normal working conditions, the latter being replaced by the combination of a floating system and of a riser part having characteristics allowing to withstand stresses. This is made possible by a poorly rough marine environment.

BRIEF DESCRIPTION OF THE DRAWINGS

Other features and advantages of the present invention will be clear from reading the description hereafter, given by way of non limitative example, with reference to the accompanying drawings wherein.

DESCRIPTION OF THE INVENTION

Figure 1:
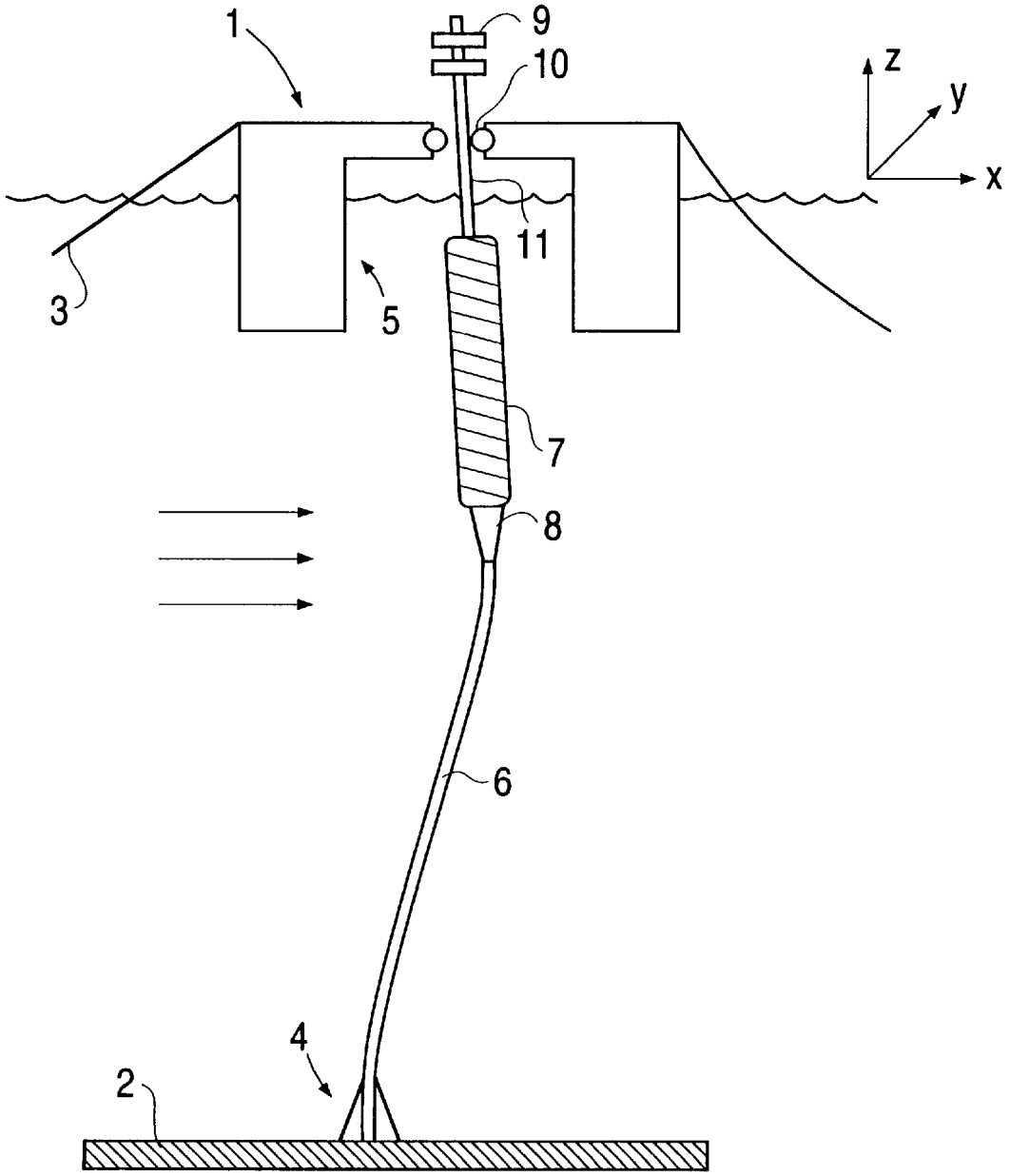
FIG. 1 diagrammatically shows a production system showing notably the specific layout of the upper part of the production riser according to the invention acting as a stiffener.

FIG. 1 shows an example of a production system illustrating the specific layout of the various elements forming the invention, notably the absence of the tensioning system commonly used in the prior art under normal working conditions between a riser and the floater, or between a riser carrying deck and the floater, that is replaced by the presence of a stiffener placed at the level of the part of the riser connected to the floater.

The production system comprises, for example, a floater 1 anchored to the sea bottom 2 by means 3, for example a set of chains or of taut lines, such as a tendon. Floater 1 is placed in proximity to a source of petroleum effluents, for example one or more production wells 4. Floater 1 comprises a cavity 5 allowing passage of production riser or risers 6.

A production riser 6 is fastened for example by a first end to a subsea structure comprising the production well or wells with the aid of connecting means commonly used in the petroleum industry. Riser 6 is maintained under tension by an upward traction whose value is preferably constant. It is preferably placed under tension by setting, over at least part of the length of the riser, one or more floats 7 (or tensioning buoys) whose function is notably to exert a sufficient tension so as to prevent buckling of the riser. A single tensioning buoy surrounding the upper end of riser 6, dimensioned so as to pretighten the riser and to keep it pretight, can be used. Tensioning means 7 can also be distributed all along this riser or over at least part of the length thereof, by distributing for example several tensioning buoys, the array of buoys (number and dimensions) being selected so as to obtain a given pretension in the riser.

A bending limiter 8 is advantageously set at the level of the junction between the buoy and the riser, for example at the lower junction thereof, in order to minimize the bending effects and the stresses undergone by the riser under the effect of the wave motion, the hydrodynamic forces and other exterior elements.

In this non limitative embodiment example of the invention, wellhead 9 is placed at the level of the upper end of the riser.

Without departing from the scope of the invention, it is possible to conceive other positions for the wellhead, for example the wellhead can be placed on the sea bottom, or at various levels between the sea bottom and the sea surface.

The upper end of the riser can be connected to the floater by means 10 allowing longitudinal sliding of the riser along an axis z, and simultaneously guidance thereof in a plane substantially perpendicular to the longitudinal axis, for example along axes or directions x, y schematized in FIG. 1.

Means 10 include in this embodiment example rollers allowing free rotation in the three directions x, y and z.

One of the specificities of the production system is to avoid using the complex hauling devices commonly used under normal working conditions and providing connection between a production riser and a floating structure, and to replace them by adapting the part of the riser connected to the floater.

Figure 3:
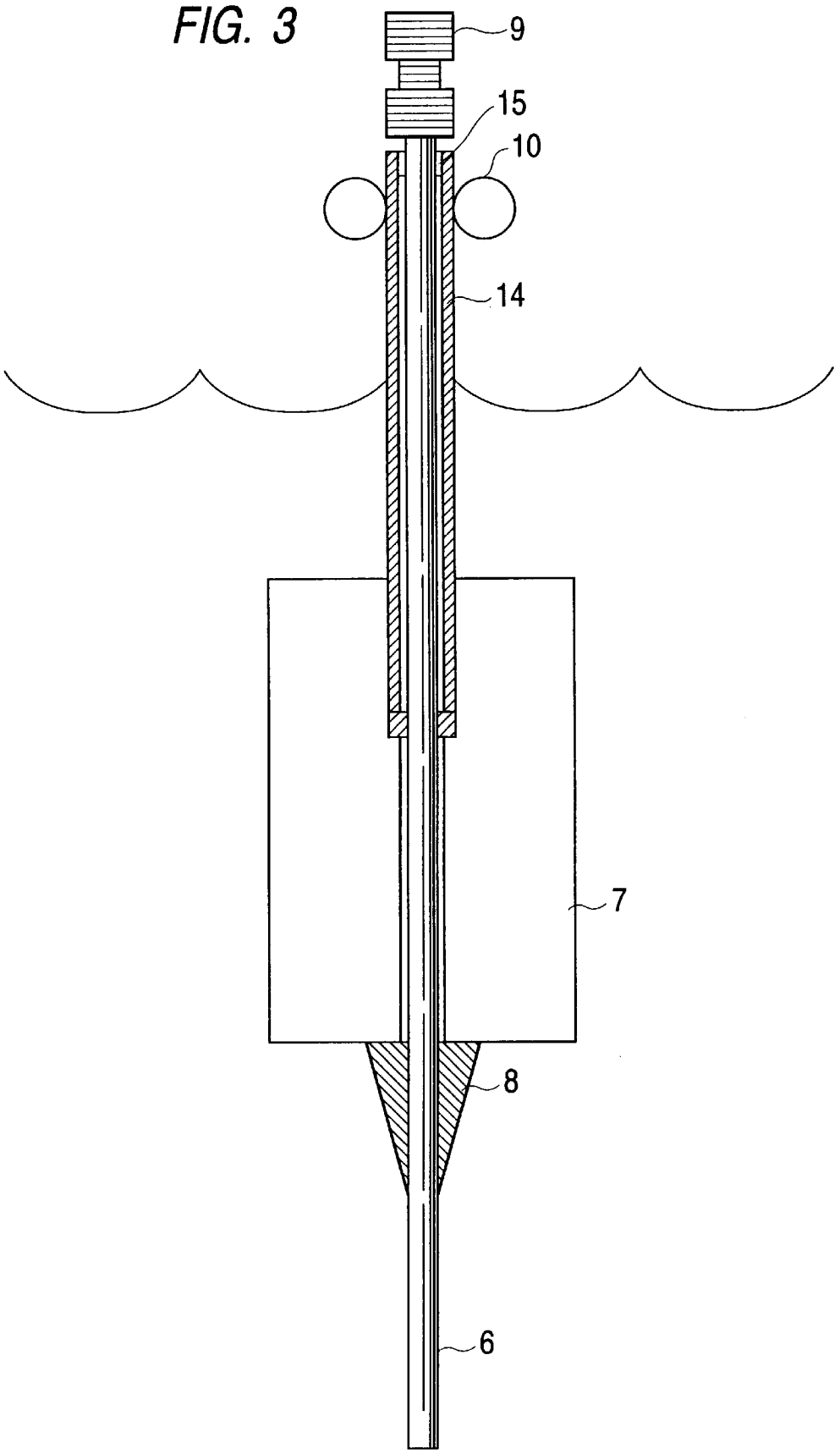

It is conceivable to adapt the characteristics of the riser itself on part of the length thereof (FIG. 1) so that it acts as a stiffener or to provide it with an individual stiffener as described in FIG. 3.

In all the embodiment examples, the invention uses a dimensioning method which is explained in connection with FIG. 1.

The geometry and the dimensions of the part of the riser acting as a stiffener 11 are determined and suited to withstand the strains undergone by the riser, these strains being notably induced by the stresses transmitted by the marine environment on the one hand, compulsory passage at a given point with substantially vertical sliding at the level of the supporting and guide means connected to the floater on the other hand, and the stresses due to the weight of the assembly.

Parameters to be Taken into Account

For dimensioning of the upper part of the riser or of the individual stiffener, and/or of an array of risers, the sprung weight of the riser, the oceanographic weather conditions and/or the corresponding motions of the floater are taken into account, floats 7, or the tensioning buoy that equips the riser is for example dimensioned so as to communicate thereto a tension ranging between 1.2 and 1.8 times the sprung weight thereof, bending limiter 8 placed below float 7 will be so determined that the bending stresses due to the shape and stiffness transition between the riser and the float are acceptable, in terms of induced stresses, the part of the riser 11 acting as a stiffener, that is situated between the top of float 7 and wellhead 9, is dimensioned so as to support two types of loads: the weight of the wellhead, the stiffness must be calculated in order to prevent so-called buckling phenomena; and the strains induced by the currents and the wave motion that are communicated thereto at the level of the rollers in the form of a flexion. In the instance of an individual stiffener, this requires adaptation of a tubular element whose diameter and thickness will be suited to remain within the limits allowed by the characteristics of the material used, the length of the stiffener is selected so as to maintain the float below the sea level and to prevent the wellhead from bumping against the supporting means.

Dimensioning Stages for the Stiffener or the Part of the Riser Acting as a Stiffener The stresses used for dimensioning of the stiffener are reminded hereafter:

The bending stress σf is given by the following equation:

$$\sigma f = \tfrac{1}{2}(Ecd_0) \cong (4M)/\pi d_0^2 e$$

where

C is the curvature of the riser,

E Young's modulus, $d_0$ the outside diameter of the part of the riser acting as a stiffener or that of casing 14, M the moment of the riser, e the thickness of the riser, of the stiffener part 1 or of casing 14.

One tries to decrease the bending stresses by increasing the thickness and/or the diameter of the riser or of the casing.

The tensile stress σt is given by the following equation:

$$\sigma t = (Ttop)/(\pi e(d_0 - e))$$

where Ttop is the value of the tension at the top of the riser.

It can be noted that it is easier to decrease this stress by increasing the thickness rather than the diameter.

In cases where the relation σf>σt is proved, the diameter parameter will be varied first prior to recalculating the stresses.

Stages

The riser being supported at two points in order to simulate holding up of the upper end thereof with respect to the floater and of the lower end thereof with respect to the sea bottom, 1) Quasi-static extreme (substantially balanced) conditions are selected; these conditions can be given by maximum roll or pitch angle values (angle formed by the riser and the floater) or by uncommon current values such as hundred-year currents, or by extreme floater offset values, 2) A first stage where the riser is not provided with a stiffener is carried out. During this stage, the distribution curves of the moment values along the riser from which the bending stress values are deduced are determined by means of a suitable software known to the man skilled in the art, or the values of the stresses along the riser, the bending stress and the tensile stress, are directly determined, 3) The stress values are compared with threshold values at each point of the riser, the threshold values corresponding to an initially selected standard, 4) When the values of stresses σf, σt are greater than the threshold values σfs, σts, the value of the thickness e and/or the value of the outside diameter $d_0$ of the riser are varied and the stresses are recalculated until values that are acceptable in relation to the standard to be complied with by the riser are obtained, 5) The values of $e_f$ and $d_{0f}$ that will allow dimensioning of the stiffener are noted.

The values of the thickness $e_f$ and of the outside diameter $d_0$ obtained at the end of the method characterize the stiffener and/or the part of the riser acting as a stiffener over the length L between the wellhead and the tensioning buoy.

Transition and connection between this specific part acting as a stiffener and the rest of the riser will be achieved according to principles known to the man skilled in the art.

The threshold values or allowable values are defined from the standard specified for the riser, which notably depends on the use thereof.

Thus, for offshore drilling risers, the standard is the API RP16Q standard. Without departing from the scope of the invention, dimensioning of the riser pipes and of the corresponding stiffener is possible by selecting other standards or other values according to the final working characteristics.

In cases where the stiffener consists of an element 14 as described in FIG. 3, this element has a thickness e and an outside diameter $d_0$ defined according to the above-mentioned stages, the length L of this element being determined like that of the riser part acting as a stiffener.

Figure 2:
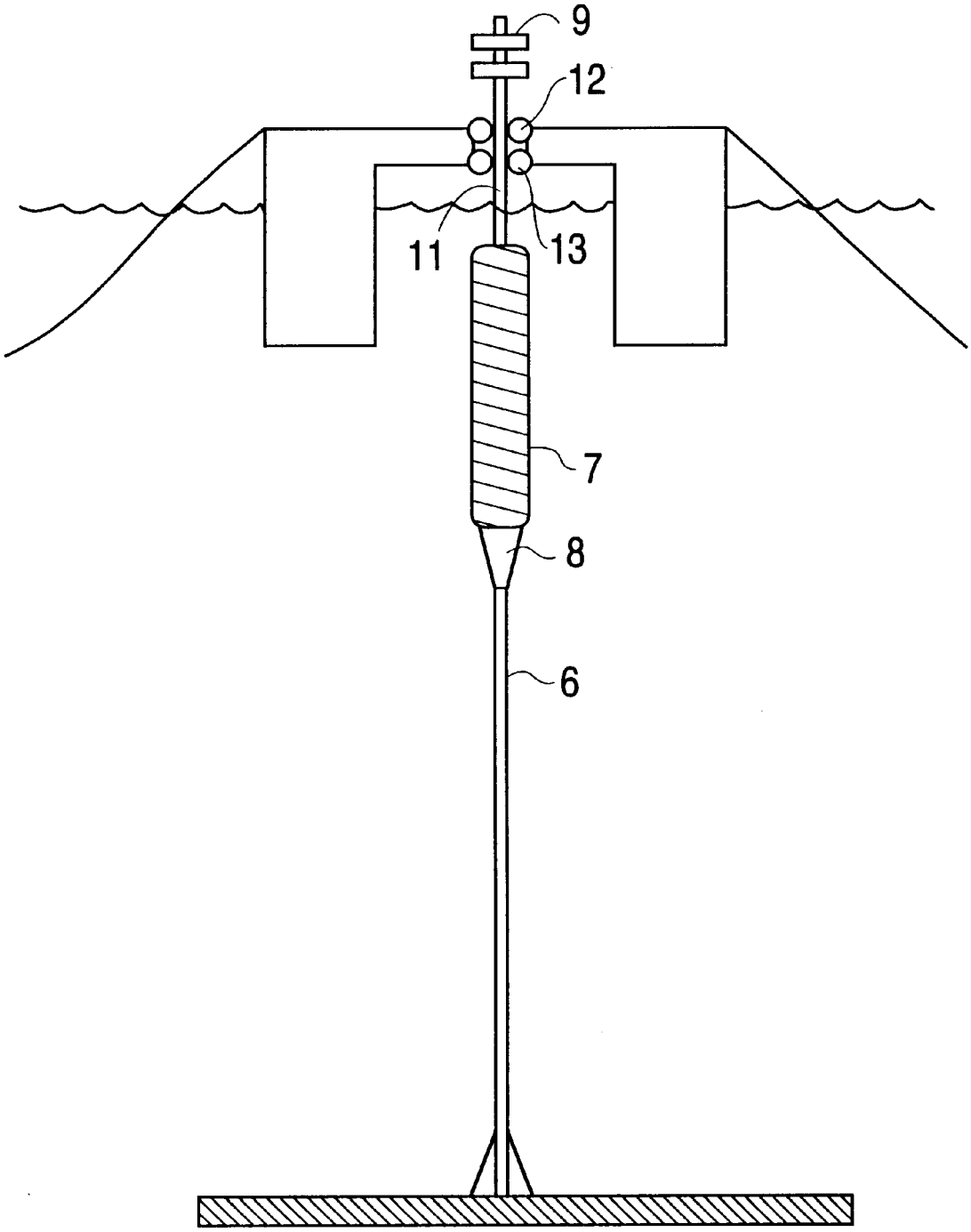
FIG. 2 shows an embodiment variant of the means intended to support and to guide the riser with respect to a floater, and FIG. 3 diagrammatically shows a variant where the riser is equipped with a stiffener and a casing.

FIG. 2 shows an embodiment variant where the device connecting the upper part of the riser and the floater comprises for example two knuckles 12, 13 placed one above the other. The distance between these two knuckles is for example of the order of some meters.

In relation to the connecting device comprising a single knuckle, the double-knuckle system advantageously allows to limit substantially horizontal displacements along axes x, y (FIG. 1). By limiting the displacement of the riser with respect to the axis of the knuckle, displacement of the wellhead at the upper end of the riser is also limited and/or the compatibility of the wellhead with the riser is improved.

The production system according to the invention can comprise, without departing from the scope of the invention, several risers equipped with at least one stiffener according to the invention.

The production risers are for example set with respect to the floater by means of a device directly connected to the floater and provided with openings allowing passage of the risers, such as a grate not shown in the figure but described in patent application FR-96/16,329. Each of these openings comprises for example a single-knuckle or a double-knuckle system as described previously in FIGS. 1 and 2.

FIG. 3 diagrammatically shows an embodiment variant where the upper part of the riser or stiffener comprises a casing 14 placed for example around the upper part of the riser, situated for example above the float.

The characteristics of this casing, the length, thickness and outside diameter thereof will be selected according to the method described above.

In some cases, it may be interesting to set, between the upper part of the riser situated within casing 14 and the casing, a tensioning means represented by reference number 15, whose purpose is notably to take up the deformations of the inner riser, for example the elongation thereof under the effect of temperature and/or pressure variations.

The assembly consisting for example of casing 14 and the upper part of the riser situated inside may also be regarded as a stiffener, dimensioning of the assembly being performed according to the stages described above.

The aforementioned dimensioning method can apply to any stiffener intended to equip production risers, drilling risers or production risers used during drilling operations.

We claim:

1. A marine petroleum installation, comprising:

a floater;

at least one production riser having a length extending from a production site to the floater;

at least one tensioning buoy placing said riser under tension;

at least one supporting and guiding device supporting and guiding the riser (6) with respect to said floater; and at least one stiffener having a length (L) provided on part of the length of the riser above said tensioning buoy, said stiffener being suited to withstand strains induced by stresses transmitted by the marine environment, stresses induced by said supporting and guiding device and stresses due to loads supported by said stiffener.

2. A marine petroleum installation as claimed in claim 1, wherein said stiffener comprises a casing of length L surrounding said riser.

3. A marine petroleum installation as claimed in claim 2, further comprising an auxiliary tensioning means connecting the riser to the casing.

4. Use of the riser as claimed in claim 3, for production of petroleum effluents.

5. Use of the riser as claimed in claim 3, for drilling of petroleum wells.

6. A marine petroleum installation as in claim 1, further comprising an element preventing bending problems between the riser and the tensioning buoy.

7. A marine petroleum installation as in claim 1, wherein said supporting and guiding device comprises at least one roller bearing system allowing vertical sliding of the riser and guiding horizontal displacements thereof in a plane substantially perpendicular to the longitudinal sliding axis.

8. A marine petroleum installation as claimed in claim 1, wherein the supporting and guiding device comprises at least one double bearing system.

9. A marine petroleum installation as claimed in claim 1, wherein said riser comprises two ends, one of the two ends communicating with a production well and the other with a wellhead, said wellhead being placed above the tensioning buoy.

10. A marine petroleum installation as claimed in claim 1, wherein the installation comprises several risers, said risers being connected to the floater by a grate equipped with means for guiding said risers.

11. Use of the marine petroleum installation as claimed in claim 1 for production of petroleum effluents.

12. Use of the marine petroleum installation as in claim 1, for drilling of petroleum wells.

13. A riser, comprising, a riser pipe, at least one tensioning buoy provided on the riser pipe, and at least one stiffener provided on at least part of a length of the riser pipe, the at least one stiffener being provided above the tensioning buoy, having a length (L) and having characteristics suited to withstand strains induced by stresses transmitted by a marine environment, stresses induced by a supporting and guide means and stresses due to loads supported by said stiffener.

14. A riser according to claim 9, wherein said at least one stiffener has thickness e and an outside diameter $d_0$ determined by the steps of:

a) selecting quasi-static extreme conditions given by maximum roll or pitch angle values or uncommon current values or by extreme floater offset values, b) determining a value of moment M by means of software for the riser not yet equipped with a stiffener, wherein values of bending and of tensile stresses are deduced and/or a value of bending stresses $\sigma f$ and/or of tensile stresses $\sigma t$ in the riser are directly determined, the riser being not yet equipped with a stiffener, c) comparing stress values deduced in step b) with threshold values $\sigma fs$ and $\sigma ts$ at each point of the riser, d) when the stress values $\sigma f$, $\sigma t$ are greater than the threshold values, varying a value of the thickness e and/or a value of the outside diameter $d_0$ of the riser and recalculating the stresses $\sigma f$, $\sigma t$ until stress values acceptable in relation to a standard to be complied with by the riser are obtained, and noting final values $e_f$, $d_{0f}$, and e) dimensioning the stiffener with said final values.

15. A riser as claimed in claim 14, wherein said stiffening element comprises a tubular element having a length substantially equal to L, a thickness e and an outside diameter $d_0$, said tubular element surrounding the riser.

16. A riser as claimed in claim 15, wherein said tubular element is connected to the riser by a tensioning element.

17. A marine petroleum installation according to claim 13, wherein said at least one stiffener has thickness e and an outside diameter $d_0$ determined by the steps of:

a) selecting quasi-static extreme conditions given by maximum roll or pitch angle values or uncommon current values or by extreme floater offset values, b) determining a value of moment M by means of software for the riser not yet equipped with a stiffener, wherein values of bending and of tensile stresses are deduced and/or a value of bending stresses $\sigma f$ and/or of tensile stresses $\sigma t$ in the riser are directly determined, the riser being not yet equipped with a stiffener, c) comparing stress values deduced in step b) with threshold values $\sigma fs$ and $\sigma ts$ at each point of the riser, d) when the stress values $\sigma f$, $\sigma t$ are greater than the threshold values, varying a value of the thickness e and/or a value of the outside diameter $d_0$ of the riser and recalculating the stresses $\sigma f$, $\sigma t$ until stress values acceptable in relation to a standard to be complied with by the riser are obtained, and noting final values $e_f$, $d_{0f}$, and e) dimensioning the stiffener with said final values.

* * * * *